US006529107B2

(12) United States Patent
Shimizu et al.

(10) Patent No.: US 6,529,107 B2
(45) Date of Patent: Mar. 4, 2003

(54) SPEAKER COMPRISING RING MAGNET

(75) Inventors: Motoharu Shimizu, Saitama-ken (JP); Hiroyuki Daichoh, Saitama-ken (JP)

(73) Assignee: Hitachi Metals Ltd., Tokyo (JP)

( * ) Notice: Subject to any disclaimer, the term of this patent is extended or adjusted under 35 U.S.C. 154(b) by 0 days.

(21) Appl. No.: 09/736,182

(22) Filed: Dec. 15, 2000

(65) Prior Publication Data

US 2002/0075110 A1 Jun. 20, 2002

(30) Foreign Application Priority Data

Dec. 16, 1999 (JP) ..... 11-357676

(51) Int. Cl.[7] ..... H01F 7/02
(52) U.S. Cl. ..... 335/302; 381/412; 381/420
(58) Field of Search ..... 335/302–306; 310/152–156; 381/412–422

(56) References Cited

U.S. PATENT DOCUMENTS 4,536,230 A 8/1985 Landa et al. ..... 148/31.57

FOREIGN PATENT DOCUMENTS

| | | |
|---|---|---|
| JP | 04023410 A | 1/1992 |
| JP | 05176509 A | 7/1993 |
| JP | 10177928 A | 6/1998 |
| JP | 10304634 A | 11/1998 |

*Primary Examiner*—Ramon M. Barrera
(74) *Attorney, Agent, or Firm*—Sughrue Mion, PLLC

(57) ABSTRACT

A ring magnet having improved linearity and/or peak value in a pace magnetic flux density distribution, comprising at least one first radially anisotropic region having a radial anisotropy direction of 89° or more relative to a center axis thereof, and at least one second radially anisotropic region having a radial anisotropy direction of 40° or more and less than 89° relative to a center axis thereof, the first and second radially anisotropic regions being arranged along the center axis such that a space magnetic flux density distribution on an inner or outer surface of the ring magnet has increased linearity and/or peak value.

4 Claims, 5 Drawing Sheets

SPEAKER COMPRISING RING MAGNET

FIELD OF THE INVENTION

The present invention relates to a radially anisotropic ring magnet with improved linearity and/or peak value in a space magnetic flux density distribution than those of conventional ring magnets, and a speaker comprising such a radially anisotropic ring magnet for having improved linearity and/or peak value in thrust of a voice coil.

BACKGROUND OF THE INVENTION

Speakers of moving coil type have conventionally been used widely. A moving coil-type speaker is a speaker comprising a magnet and a yoke for generating a thrust for moving a voice coil in a magnetic gap, the voice coil coupled with a vibration system being movably disposed in the magnetic gap, and a driving current is caused to flow through the voice coil to generate sound.

FIG. 6 is a cross-sectional view showing an important part of a conventional moving coil-type speaker. In FIG. 6, a frame 1 formed by die-cast aluminum, etc. comprises a substantially conical upper frame 1*a* and a substantially arm-shaped lower frame 1*b* coupled with each other by screws 1*c*. The lower frame 1*b* is integrally provided with a cylindrical projection 1*d* at center, and a cylindrical inner yoke 7 made of a ferromagnetic material such as iron is fixed to an outer surface of a small-diameter portion 1*e* at a tip end of the projection 1*d*. Two voice coils 6*a*, 6*b* wound in opposite directions are closely fixed to an outer surface of the inner yoke 7 with a gap therebetween in a vertical direction. Disposed around the outer surfaces of the voice coils 6*a*, 6*b* with a slight magnetic gap are radially magnetized ring magnets 5*a*, 5*b*. The ring magnet 5*a* is magnetized such that its inner surface has an N pole and its outer surface has an S pole. The ring magnet 5*b* is magnetized such that its inner surface has an S pole and its outer surface has an N pole. The outer surfaces of the ring magnets 5*a*, 5*b* are adhered to the inner surface of the cylindrical outer yoke 4.

The ring magnets 5*a*, 5*b* used in the speaker shown in FIG. 6 are magnetized radially, and this speaker can avoid damage to its vibration system due to excess vibration generated when excess current flows through the voice coil, without needing a special safety gear. In the moving coil-type speaker, a driving current is enhanced to increase a stroke of the vibration system, to obtain a sound pressure in a low sound region on the same level as those in middle and high sound regions. To increase the stroke of the vibration system, increase in the linearity and/or peak value of the thrust of the voice coil is effective, desirable for satisfying the recent demand for miniaturization and increase in performance of speakers.

However, when a driving current is increased to enlarge the thrust of the voice coil, heat generated from the voice coil increases in proportion to the driving current. Thus, the temperature elevation (burning) of the voice coil should be prevented by limiting electric power supplied to the speaker and improving the heat dissipation of the speaker. Therefore, it is actually difficult to increase the thrust of the voice coil. It has also been found that when a moving coil-type speaker is constituted by conventional ring magnets 5*a*, 5*b*, linearity and/or peak value cannot fully be increased in an effective space magnetic flux density distribution crossing the voice coil movably disposed in the magnetic gap.

OBJECT OF THE INVENTION

Accordingly, an object of the present invention is to provide a speaker comprising a radially anisotropic ring magnet for providing improved linearity and/or peak value in the thrust of a voice coil as compared to conventional ones.

SUMMARY OF THE INVENTION

As a result of intense research in view of the above objects, the inventors have found that a radially anisotropic ring magnet with improved linearity and/or peak value in a space magnetic flux density distribution is obtained by providing a plurality of radially anisotropic regions along a center axis of the ring magnet, and by making a radial anisotropy direction in each region different from each other, and thus achieving the present invention.

The radially anisotropic ring magnet according to one embodiment of the present invention comprises at least one first radially anisotropic region having a radial anisotropy direction of 89° or more relative to a center axis thereof; and at least one second radially anisotropic region having a radial anisotropy direction of 40° or more and less than 89° relative to a center axis thereof, the first and second radially anisotropic regions being arranged along the center axis such that a space magnetic flux density distribution on an inner or outer surface of the ring magnet has increased linearity and/or peak value.

The radially anisotropic ring magnet according to another embodiment of the present invention comprises a plurality of radially anisotropic regions having radial anisotropy directions of 40° or more and less than 89° relative to a center axis thereof, the plurality of radially anisotropic regions being arranged along the center axis such that a space magnetic flux density distribution on an inner or outer surface of the ring magnet has increased linearity and/or peak value.

From the practical point of view, the above ring magnet is preferably made of an R—T—B permanent magnet having as a main phase an $R_2T_{14}B$ intermetallic compound, wherein R is at least one rare earth element including Y, at least one of Nd, Dy and Pr being indispensable, and T is Fe or Fe and Co.

The present invention also provides a speaker comprising the above ring magnet.

BRIEF DESCRIPTION OF THE DRAWINGS

FIG. 1(*b*) is a schematic view showing an angle θ of the radial anisotropy direction relative to a center axis;

FIG. 4(*b*) is an enlarged view showing an important part of the speaker in FIG. 4(*a*);

BEST MODE FOR CARRYING OUT THE INVENTION

Figure 1A:
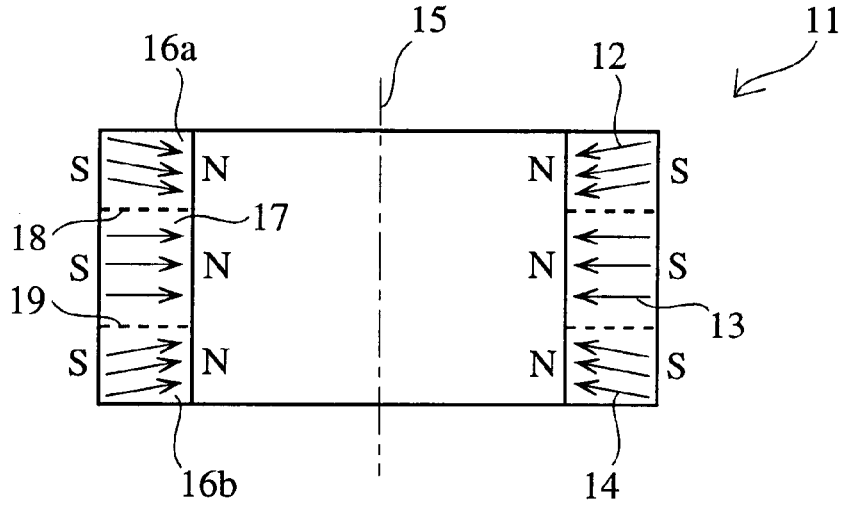
FIG. 1(*a*) is a cross-sectional view showing the ring magnet according to one embodiment of the present invention.

[1] Ring Magnet (A) Composition of Magnet (1) Sintered R—T—B magnet

The sintered R—T—B magnet constituting the ring magnet of the present invention has a composition comprises 27–34% by weight of R, wherein R is at least one rare earth element including Y, and 0.5–2% by weight of B, the balance being substantially T, wherein T is Fe or Fe and Co, and inevitable impurities, the total of main components R, B and T being 100% by weight, and has a main phase constituted by an $R_2T_{14}B$ intermetallic compound.

From the practical point of view, R is preferably at least one of Nd, Dy and Pr. The content of R is preferably 27–34% by weight. When R is less than 27% by weight, the R—T—B magnet has drastically decreased coercivity iHc. On the other hand, when R is more than 34% by weight, the residual magnetic flux density Br of the magnet largely decreases.

The content of B is preferably 0.5–2% by weight. When B is less than 0.5% by weight, practically useful iHc cannot be obtained. On the other hand, when B is more than 2% by weight, Br is drastically reduced. The more preferred content of B is 0.8–1.5% by weight.

To improve magnetic properties, at least one of Nb, Al, Co, Ga and Cu is preferably added in a proper amount.

The content of Nb is preferably 0.1–2% by weight. The addition of Nb results in the formation of borides of Nb during the sintering process, thereby suppressing the irregular growth of crystal grains. When Nb is less than 0.1% by weight, enough effects are not obtained. On the other hand, when Nb is more than 2% by weight, too much Nb borides are formed, resulting in drastic decrease in Br.

The content of Al is preferably 0.02–2% by weight. When Al is less than 0.02% by weight, enough effects are not obtained. On the other hand, when Al is more than 2% by weight, Br drastically decreases.

The content of Co is preferably 0.3–5% by weight. When Co is less than 0.3% by weight, effects of improving a Curie temperature and adhesion of a Ni plating cannot be obtained. On the other hand, when Co is more than 5% by weight, Br and iHc drastically decrease.

The content of Ga is preferably 0.01–0.5% by weight. When Ga is less than 0.01% by weight, effects of improving iHc cannot be obtained. On the other hand, when Ga is more than 0.5% by weight, decrease in Br is remarkable.

The content of Cu is preferably 0.01–1% by weight. Though the addition of a trace amount of Cu contributes to increase in iHc, effects are saturated when the content of Cu exceeds 1% by weight. On the other hand, when Cu is less than 0.01% by weight, enough effects cannot be obtained.

With the total amount of the ring magnet being 100% by weight, the amounts of inevitable impurities are such that oxygen is preferably 0.6% by weight or less, more preferably 0.3% by weight or less, particularly preferably 0.2% by weight or less, that carbon is preferably 0.2% by weight or less, more preferably 0.1% by weight or less, that nitrogen is 0.08% by weight or less, that hydrogen is 0.02% by weight or less, and that Ca is preferably 0.2% by weight or less, more preferably 0.05% by weight or less, particularly preferably 0.02% by weight or less.

(2) Other Magnets

The ring magnet of the present invention may also effectively be made of a permanent magnet having $SmCo_5$ or $Sm_2TM_{17}$, wherein TM comprises Co, Fe, Cu and M, M being at least one selected from the group consisting of Zr, Hf, Ti and V.

The ring magnet of the present invention may also effectively be made of a magnetoplumbite-type ferrite magnet. Such a ferrite magnet has a basic composition represented by the general formula:

$$(A_{1-x}R'_x)O\cdot n[(Fe_{1-y}M_y)_2O_3](\text{atomic }\%)$$

wherein A is Sr and/or Ba, R' is at least one rare earth element including Y, La being indispensable, M is Co or Co and Zn, and x, y and n are numbers satisfying $0.01 \leqq x \leqq 0.4$, $0.005 \leqq y \leqq 0.04$, and $5.0 \leqq n \leqq 6.4$.

The ring magnet of the present invention may also effectively be formed by a hot-worked R—T—B magnet made of a fine crystalline alloy having as a main phase (average crystal grain size: 0.01–0.5 μm) an $R''_2T_{14}B$ intermetallic compound, wherein R" is at least one rare earth element including Y, Nd being 50 atomic % or more per R", the R—T—B magnet being provided with radial anisotropy by hot working.

(B) Structure (1) First Ring Magnet

Figure 1B:
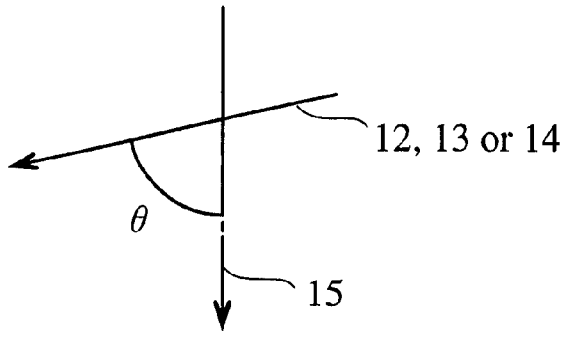

In the first ring magnet shown in FIG. 1, region 16*a*:region 17:region 16*b*=5–40:90–20:5–40 by a volume ratio.

The ring magnet of the present invention has a total length L in a longitudinal direction and an inner diameter Di, preferably L=1–150 mm, and Di=5–150 mm, and more preferably L=5–100 mm, and Di=10–100 mm. At Di<150 mm, it is industrially difficult to provide the ring magnet with good radial anisotropy. Also at Di>150 mm, the ring magnet does not meet recent demand of miniaturization. Further, at L<1 mm, the ring magnet has drastically reduced magnetic properties. At L>150 mm, the ring magnet does not meet recent demand of miniaturization.

(2) Second Ring Magnet

Figure 2:
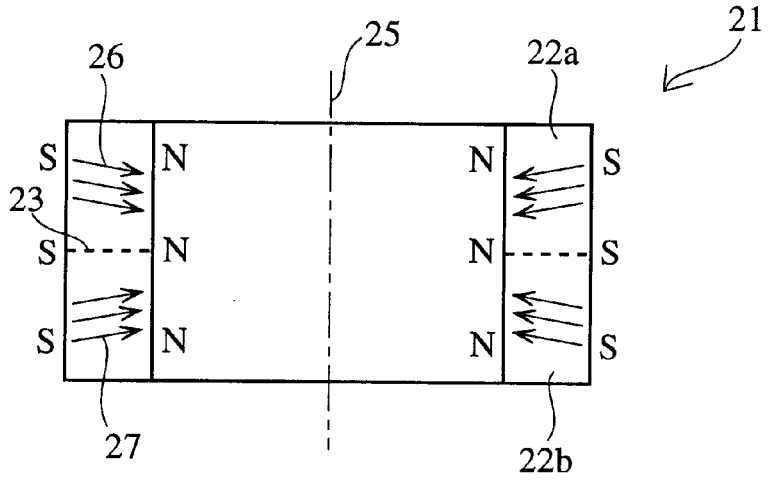
FIG. 2 is a cross-sectional view showing the ring magnet according to another embodiment of the present invention.

In the second ring magnet shown in FIG. 2, region 22*a*:region 22*b*=5–95:95–5 by a volume ratio.

[2] Speaker

Figure 4A:
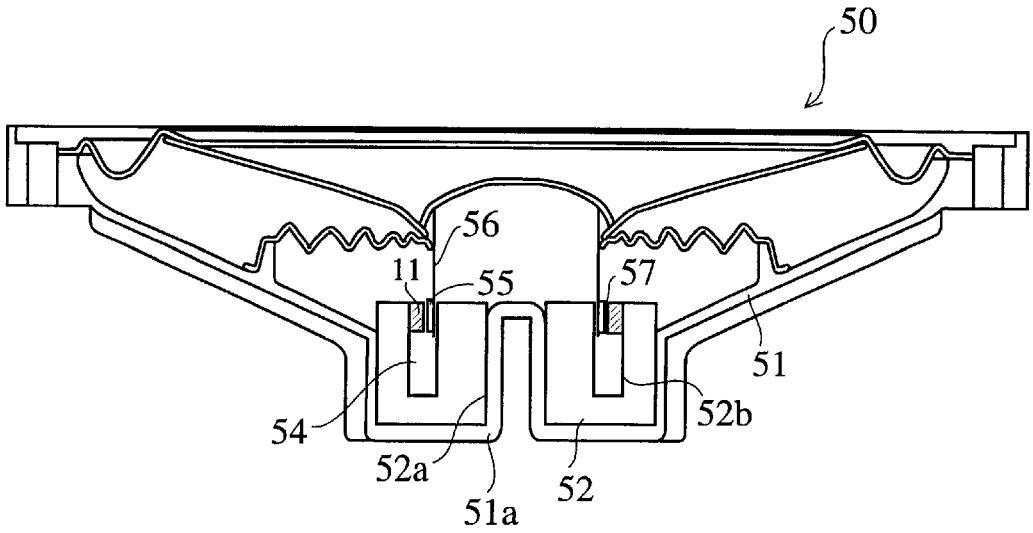
FIG. 4(*a*) is a cross-sectional view showing an important part of the speaker according to one embodiment of the present invention.
Figure 4B:
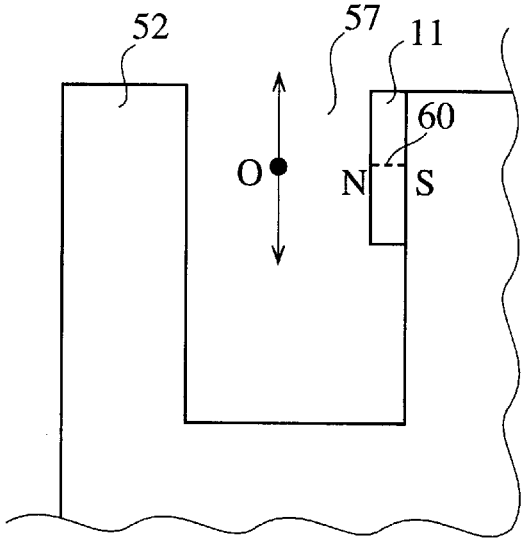

FIG. 4(*a*) is a cross-sectional view showing an important part of the speaker 50 of the present invention. In the speaker 50, a frame 51 is provided with a projection 51*a* on a bottom, and an inner surface 52*a* of a hollow, cylindrical ferromagnetic yoke 52 (for instance, made of SS40) having an opening 54 is bonded by an adhesive to an outer surface of the projection 51*a* of the frame 51. Also, a magnetized ring magnet 11 produced in EXAMPLE 1 is bonded by an adhesive to a side surface 52*b* of a yoke 52 facing the opening 54. A voice coil 55 wound around a bobbin 56 connected to a diaphragm is disposed in opposite to an N pole of the ring magnet 11. The voice coil 55 is vertically movable in a magnetic gap 57 defined by the ring magnet 11 and the yoke 52, and the thrust of the voice coil 55 vibrates a vibration system to generate sound.

The present invention will be explained in further detail by the following EXAMPLES without intention of restricting the scope of the present invention thereto.

EXAMPLE 1

Coarse alloy powder having a main component composition shown by $Nd_{30.5}Dy_{1.5}B_{1.1}Fe_{bal}$ (% by weight), with the total of Nd, Dy, B and Fe being 100% by weight, was finely pulverized by a jet mill in an inert gas atmosphere to prepare fine powder having an average diameter of 4.3 μm. The resultant fine powder was charged into a cavity of a die (not shown) mounted to a compression molding apparatus in an inert gas atmosphere, and compression-molded while applying a radially orienting magnetic field corresponding to FIG. 1. The resultant green body was sintered at 1100° C. for 2 hours in vacuum of about $7\times10^{-2}$ Pa (about $5\times10^{-4}$ Torr) and then cooled to room temperature. The resultant sintered body was subjected to a heat treatment comprising heating at 900° C. for 2 hours in an Ar atmosphere, cooling to 600°

C., keeping 600° C. for 2 hours, and then cooling to room temperature. The resultant sintered body was worked to a predetermined ring shape, and then coated with a thermosetting epoxy resin at an average thickness of 16 μm by electrodeposition, to provide a ring magnet 11 having an outer diameter $D_o$ of 37 mm, an inner diameter $D_i$ of 28 mm, and a longitudinal thickness L of 8 mm.

After magnetizing the ring magnet 11, a magnetic field generated from the ring magnet 11 was measured to analyze a radial anisotropy thereof by TOSCA (available from Vector Field). As a result, results shown in Table 1 were obtained with respect to an angle θ of each magnetic line of force 12, 13, 14 relative to a center axis 15. As is shown in FIG. 1(*a*), the results of magnetic field analysis revealed that the ring magnet 11 was constituted by a radially anisotropic region 16*a* of 40°≦θ<89°, and a radially anisotropic region 17 of 89°≦θ, and a radially anisotropic region 16*b* of 40°≦θ<89°, and that a volume ratio of each radially anisotropic region was 16*a*:17:16*b*=25:50:25.

As shown in FIG. 1(*b*), the angle θ is an acute angle between the center axis 15 and the magnetic line of force, which is shown as an average value in each radially anisotropic region. In FIG. 1(*a*), 18 denotes a boundary between the region 16*a* and the region 17, and 19 denotes a boundary between the region 17 and the region 16*b*. It also schematically shows the direction of an average magnetic line of force 12 in the region 16*a*, the direction of an average magnetic line of force 13 in the region 17, and the direction of an average magnetic line of force 14 in the region 16*b*, based on the above results of magnetic field analysis.

EXAMPLE 2

A ring magnet was produced in the same manner as in EXAMPLE 1 except that a magnetic field applied during the compression molding was a radially orienting magnetic field corresponding to FIG. 2, and then evaluated. Its magnetic field analysis revealed that the ring magnet of this EXAMPLE had radially anisotropic regions shown in FIG. 2, as shown in Table 1.

COMPARATIVE EXAMPLE 1

Figure 3:
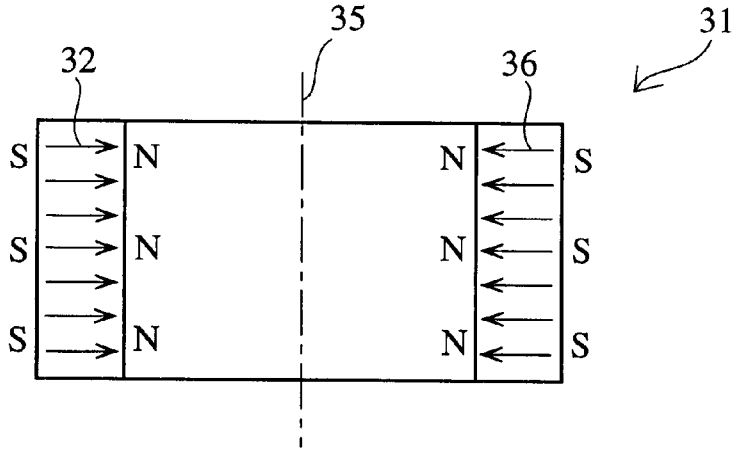
FIG. 3 is a cross-sectional view showing a conventional ring magnet.

A ring magnet was produced in the same manner as in EXAMPLE 1 except that a magnetic field applied during the compression molding was a radially orienting magnetic field corresponding to FIG. 3, and then evaluated. Its magnetic field analysis revealed that the ring magnet of COMPARATIVE EXAMPLE 1 had a radially anisotropic region schematically shown in FIG. 3, as shown in Table 1.

TABLE 1

| No. | First Radially Anisotropic Region | Second Radially Anisotropic Region | Third Radially Anisotropic Region |
|---|---|---|---|
| EXAMPLE 1 | θ = 79.6° about 25 volume % | θ = 89.1° about 50 volume % | θ = 79.9° about 25 volume % |
| EXAMPLE 2 | θ = 80.2° about 50 volume % | θ = 80.4° about 50 volume % | — |
| COMPARATIVE EXAMPLE 3 | θ = 89.1° 100 volume % | — | — |

θ = Average value.

EXAMPLE 3

Figure 5:
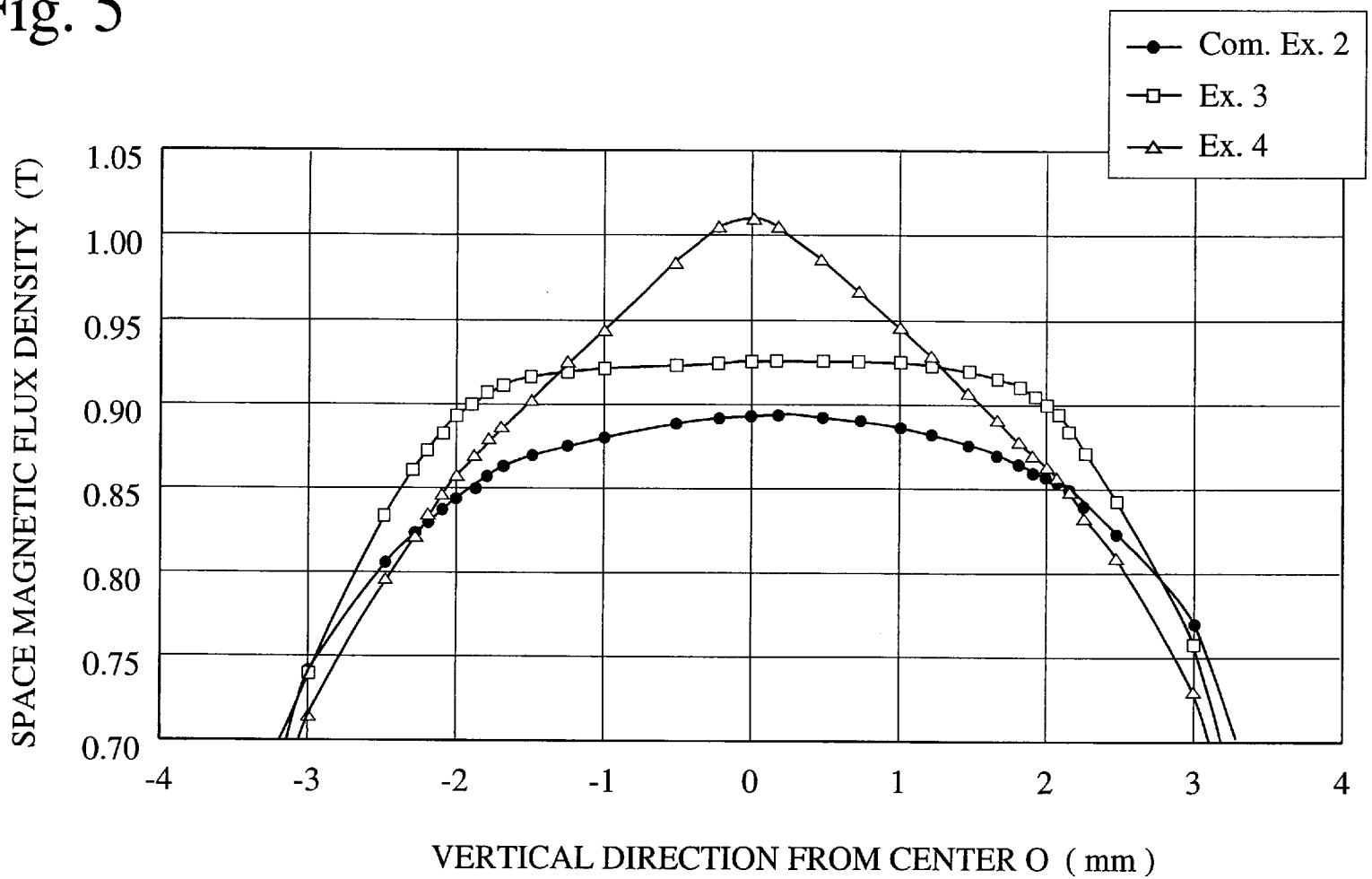
FIG. 5 is a graph showing the relations between a space magnetic flux density distribution and the distance from a center of a magnetic gap.
Figure 6:
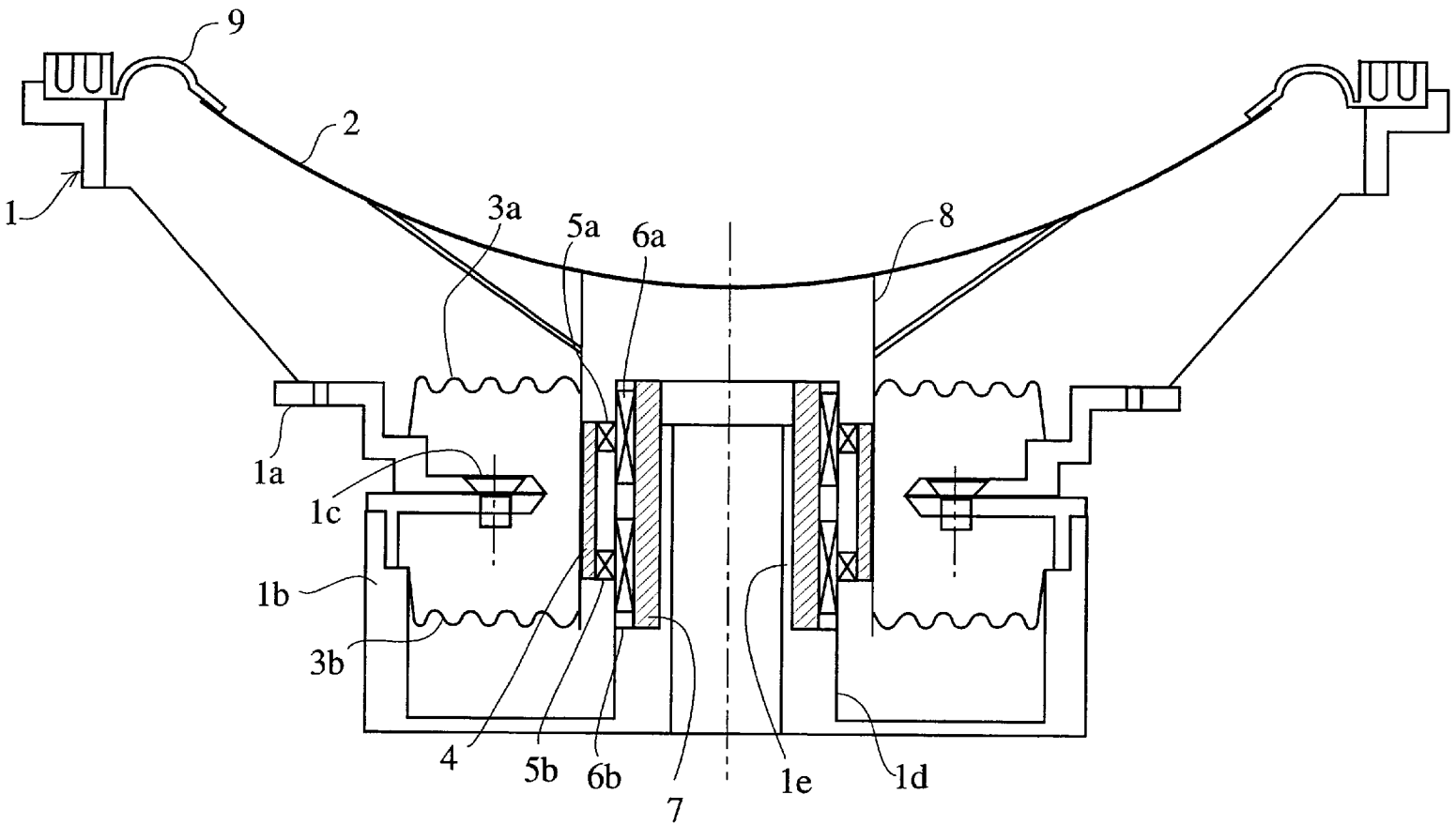
FIG. 6 is a cross-sectional view showing an important part of a conventional speaker.

In a speaker 50 shown in FIG. 4(*a*), a space magnetic flux density distribution in a magnetic gap 57 was measured when vertically moving from a center O of the magnetic gap 57 as shown in FIG. 4(*b*). Incidentally, the center O is positioned on an extension of a centerline 60 dividing the ring magnet 11 in a longitudinal direction. The measurement results are shown in FIG. 5.

EXAMPLE 4

A speaker was produced in the same manner as in EXAMPLE 3 except for using the ring magnet formed in EXAMPLE 2, and a space magnetic flux density distribution of the magnetic gap of this speaker in a vertical direction from the center thereof was measured. The results are shown in FIG. 5.

COMPARATIVE EXAMPLE 2

A speaker of COMPARATIVE EXAMPLE 2 was produced in the same manner as in EXAMPLE 3 except for using the ring magnet formed in COMPARATIVE EXAMPLE 1, and a space magnetic flux density distribution of the magnetic gap of this speaker in a vertical direction from the center thereof was measured. The results are shown in FIG. 5.

It is clear from FIG. 5 that the speaker of EXAMPLE 3 using the ring magnet of EXAMPLE 1 is superior to the speaker of COMPARATIVE EXAMPLE 2 using the ring magnet of COMPARATIVE EXAMPLE 1 in the linearity and/or peak value of a space magnetic flux density distribution. Further, as a result of measurement of the thrust of voice coils in speakers in EXAMPLE 3 and COMPARATIVE EXAMPLE 2, remarkable differences were appreciated in the thrust of voice coils in proportion to the difference in the space magnetic flux density distribution in FIG. 5.

It is also clear from FIG. 5 that though the speaker of EXAMPLE 4 using the ring magnet of EXAMPLE 2 is inferior to the speaker of COMPARATIVE EXAMPLE 2 in the linearity of a space magnetic flux density distribution, the former has a remarkably improved peak value. Further, as a result of measurement of the thrust of voice coils in speakers in EXAMPLE 4 and COMPARATIVE EXAMPLE 2, remarkable differences were appreciated in the thrust of voice coils in proportion to the difference in the space magnetic flux density distribution in FIG. 5.

Though each of EXAMPLES shows a speaker having a single ring magnet, a speaker may comprise two or more ring magnets.

As described in detail above, the present invention provides a speaker having improved linearity and/or peak value in the thrust of a voice coil as compared to those of the conventional ones by using a radially anisotropic ring magnet having improved linearity and/or peak value in a space magnetic flux density distribution as compared to those of conventional ring magnets.

What is claimed is:

1. A speaker comprising a magnetic gap formed by a pole surface of a ring magnet and a ferromagnetic yoke, and a voice coil movable along a center axis of said ring magnet in said magnetic gap, wherein said ring magnet comprises at least one first radially anisotropic region having a radial anisotropy direction of 89° or more relative to said center axis thereof, and at least one second radially anisotropic region having a radial anisotropy direction of 40° or more and less than 89° relative to said center axis thereof, said first and second radially anisotropic regions being arranged along said center axis such that a space magnetic flux density distribution on an inner or outer surface of said ring magnet has increased linearity and/or peak value.

2. The speaker comprising a ring magnet according to claim 1, wherein said ring magnet is made of an R—T—B permanent magnet having as a main phase an $R_2T_{14}B$ intermetallic compound, wherein R is at least one rare earth element including Y and T is Fe or Fe and Co.

3. A speaker comprising a magnetic gap formed by a pole surfaced of a ring magnet and a ferromagnetic yoke, and a voice coil movable along a center axis of said ring magnet in said magnetic gap, wherein said ring magnet comprises a plurality of radially anisotropic regions having a radial anisotropy directions of 40° or more and less than 89° relative to said center axis thereof, said plurality of radially anisotropic regions being arranged along said center axis such that a space magnetic flux density distribution on an inner or outer surface of said ring magnet has increased linearity and/or peak value.

4. The speaker comprising a ring magnet according to claim 3, wherein said ring magnet is made of an R—T—B permanent magnet having as a main phase an $R_2T_{14}B$ intermetallic compound, wherein R is at least one rare earth element including Y and T is Fe or Fe and Co.

* * * * *